US009670557B2

(12) United States Patent
Pedersen

(10) Patent No.: US 9,670,557 B2
(45) Date of Patent: Jun. 6, 2017

(54) SCRAPING WHEEL, A SCRAPING ROLLER AND USE OF A SCRAPING WHEEL

(71) Applicant: Jasopels A/S, Bording (DK)

(72) Inventor: Kurt Pedersen, Vinderup (DK)

(73) Assignee: Eikon Technologies Holding Sarl., Luxembourg (LU)

( * ) Notice: Subject to any disclaimer, the term of this patent is extended or adjusted under 35 U.S.C. 154(b) by 0 days.

(21) Appl. No.: 14/423,969

(22) PCT Filed: Aug. 12, 2013

(86) PCT No.: PCT/EP2013/066789

§ 371 (c)(1),
(2) Date: Feb. 25, 2015

(87) PCT Pub. No.: WO2014/032946

PCT Pub. Date: Mar. 6, 2014

(65) Prior Publication Data

US 2015/0344981 A1 Dec. 3, 2015

(30) Foreign Application Priority Data

Aug. 30, 2012 (DK) ..... 201270518

(51) Int. Cl.
*C14B 17/02* (2006.01)

(52) U.S. Cl.
CPC ..... *C14B 17/02* (2013.01)

(58) Field of Classification Search
CPC ..... C14B 17/00; C14B 17/02; C14B 19/00; C14B 1/30; C14B 1/34; C14B 1/42; A14B 2700/13; A14B 2700/12
See application file for complete search history.

(56) References Cited

U.S. PATENT DOCUMENTS 1,905,835 A * 4/1933 Finn ..... A43D 11/003 12/1 R
2,469,636 A * 5/1949 Dempsey ..... C14B 1/26 15/21.1

(Continued)

FOREIGN PATENT DOCUMENTS

DK 156 669 B3 10/1986
DK 2010 70431 10/2010

(Continued)

OTHER PUBLICATIONS

International Search Report completed Nov. 7, 2013 for International Application No. PCT/EP2013/066789.

(Continued)

*Primary Examiner* — Shaun R Hurley
*Assistant Examiner* — Bao-Thieu L Nguyen
(74) *Attorney, Agent, or Firm* — Brinks Gilson & Lione

(57) ABSTRACT

Disclosed is a scraping wheel (1) for scraping the skin side (2) of an animal pelt (3). The scraping wheel (1) comprises a scraping roller (4) including a plurality of scraping teeth (5) arranged on the outer cylindrical roller surface (6) and the scraping roller (4) further comprises a centrally arranged axial roller hole (7). The scraping wheel (1) also comprises one or more hub parts (25, 26) arranged at least partly in the centrally arranged axial roller hole (7) and connected to the scraping roller (4) through a torque transmitting connection (9), wherein the one or more hub parts (25, 26) further comprise a centrally arranged axial hub hole (10) by which the scraping wheel (1) is mounted on a drive shaft (11) driving the rotation of the scraping wheel (1) during the scraping. Disclosed is also a scraping roller (4) for scraping of the skin side (2) of an animal pelt (3). The scraping roller (4) comprises a plurality of scraping teeth (5) arranged on the outer cylindrical roller surface (6) and the scraping roller (4) further comprises a centrally arranged axial roller hole (Continued)

Figure 1:
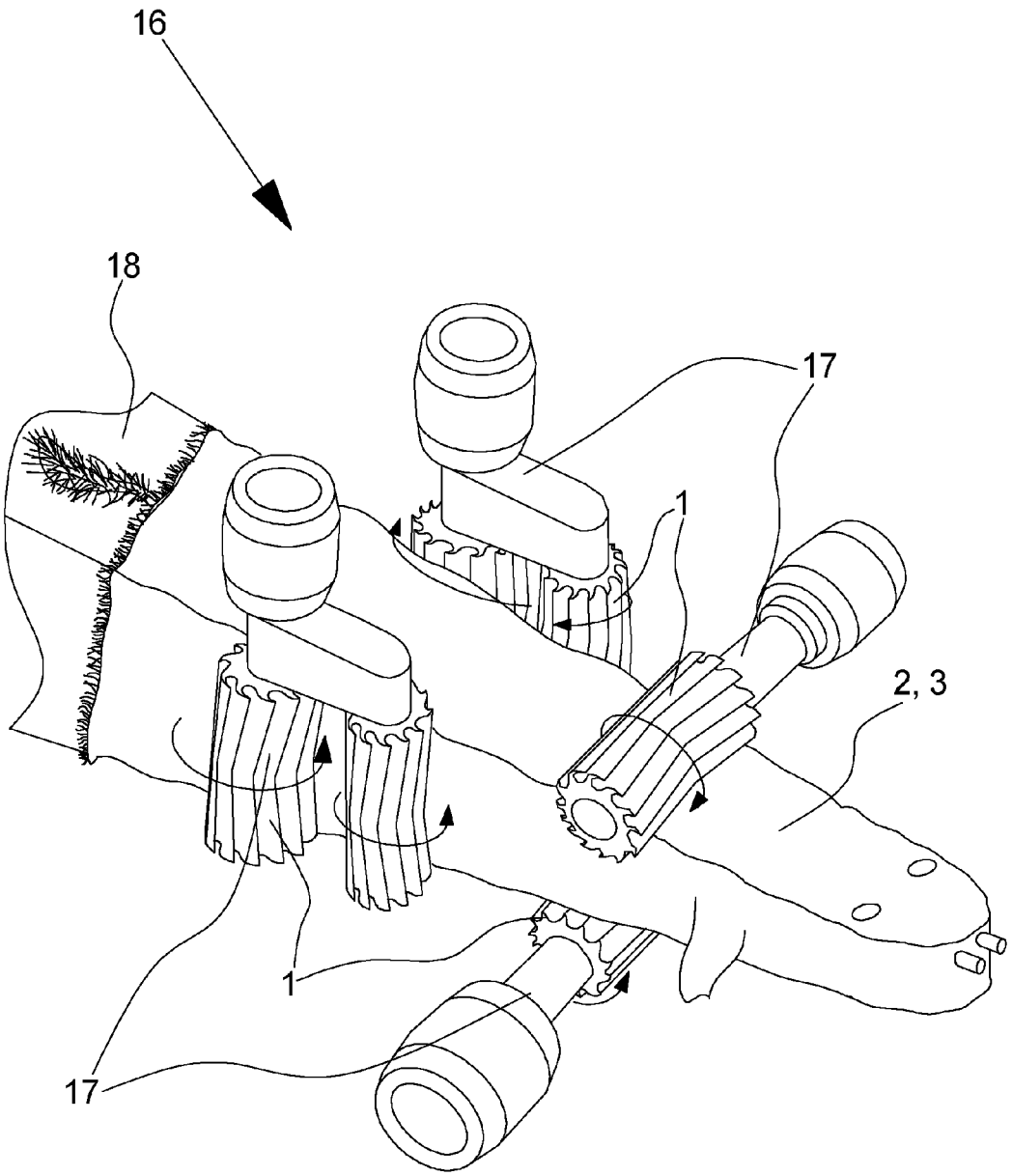

(7), wherein the roller hole (7) is provided with a plurality of dovetail shaped splines (13). Use of a scraping wheel (1) is also disclosed.

16 Claims, 4 Drawing Sheets

(56) References Cited

U.S. PATENT DOCUMENTS

| | | | | | |
|---|---|---|---|---|---|
| 2,471,984 | A * | 5/1949 | Stehling | C14B 1/02 | 69/42 |
| 2,504,219 | A * | 4/1950 | Norden | C14B 1/14 | 407/47 |
| 2,645,263 | A * | 7/1953 | Stettler | A22C 17/12 | 69/13 |
| 2,842,949 | A * | 7/1958 | Goad, Jr. | A43D 95/08 | 69/6.5 |
| 3,144,739 | A * | 8/1964 | Brutvan | B24D 5/06 | 451/450 |
| 3,210,892 | A | 10/1965 | Perham | | |
| 3,236,074 | A * | 2/1966 | Cleaves | C14B 1/30 | 69/21 |
| 3,385,010 | A * | 5/1968 | Vorce | B24D 7/02 | 451/527 |
| 3,736,776 | A * | 6/1973 | Repetto | C14B 1/02 | 69/13 |
| 4,002,380 | A * | 1/1977 | Bowen | F16C 33/34 | 384/567 |
| 4,745,782 | A * | 5/1988 | Larsen | C14B 1/10 | 69/39 |
| 4,989,427 | A | 2/1991 | Van Der Park et al. | | |
| 4,993,243 | A * | 2/1991 | Guinn | B23Q 11/06 | 30/390 |
| 5,451,198 | A | 9/1995 | Lancaster | | |
| 6,434,978 | B1 * | 8/2002 | Mance | A22B 5/166 | 69/1 |
| 6,547,340 | B2 * | 4/2003 | Harris | B60B 19/003 | 180/20 |
| 6,553,886 | B1 * | 4/2003 | Mance | C14B 1/18 | 69/10 |
| 6,826,941 | B2 | 12/2004 | Plesh, Sr. | | |
| 7,156,796 | B2 * | 1/2007 | Makley | B41F 31/22 | 492/45 |
| 8,360,830 | B2 * | 1/2013 | Klug | B24D 11/008 | 451/529 |
| 9,121,464 | B2 * | 9/2015 | Nichols | F16H 15/28 | |
| 2005/0020392 | A1 | 1/2005 | Redmond | | |
| 2009/0282939 | A1 | 11/2009 | Rogowski et al. | | |
| 2011/0092144 | A1 | 4/2011 | Woods et al. | | |
| 2013/0139560 | A1 * | 6/2013 | Pedersen | C14B 1/02 | 69/44 |

FOREIGN PATENT DOCUMENTS

| | | |
|---|---|---|
| DK | 2011 00214 L | 3/2011 |
| DK | 177 165 | 2/2012 |
| DK | 177 169 B1 | 4/2012 |
| DK | 177 201 B1 | 6/2012 |
| EP | 2 093 299 A1 | 8/2009 |
| WO | WO 2005/068665 A1 | 7/2005 |
| WO | WO 2011/116771 A1 | 9/2011 |

OTHER PUBLICATIONS

Written Opinion completed Nov. 7, 2013 for International Application No. PCT/EP2013/066789.

* cited by examiner

SCRAPING WHEEL, A SCRAPING ROLLER AND USE OF A SCRAPING WHEEL

This application claims the benefit under 35 U.S.C. §371 of International Application No. PCT/EP2013/066789, filed Aug. 12, 2013, which claims the benefit of Danish Patent Application No. PA 2012 70518, filed Aug. 30, 2012 which are incorporated by reference herein in their entirety.

FIELD OF THE INVENTION

The invention relates to a scraping wheel for scraping the skin side of an animal pelt, use of a scraping wheel and a scraping roller for scraping of the skin side of an animal pelt.

BACKGROUND OF THE INVENTION

A skin taken from a furred animal—such as a mink fur—normally has a layer or residues of fat, tendons and/or flesh that is firmly attached to the skin side of the fur. Before the fur can be used for further processing, such layers or residues must be removed from the skin side.

A prior art apparatus for processing such furs to remove layers or residues of fat, tendons and/or flesh on the skin side is described in Danish patent specification DK156669. This apparatus comprises a single scraping roller with V-shaped scraping teeth to scrape the skin on each side of a mandrel, on which a tubular fur is arranged with the skin side facing outwards.

To ensure efficient scraping of the skin the scraping rollers each have to have a relatively large diameter which also contributes to ensure that the rollers are relatively dimensionally stable even through the scraping rollers are typically made from some sort of rubber or relatively soft plastic material to ensure that the scraping rollers are flexible enough to efficiently scrape the skin.

However, this flexible property also entails that the rollers are wear parts that has to be changes e.g. for every 1000 pelts and given the complex design and the relatively large diameter of the rollers the rollers are relatively expensive.

From Danish patent application No. DK 2010 70431 in the name of Pamutec it is therefore known to provide the rollers with separate teeth made from a more durable material such as steel. But this roller design reduces the flexibility and thereby the efficiency of the rollers and it increased the cost of the rollers drastically.

An object of the invention is therefore to provide for an advantageous scraping device that is more cost-efficient.

THE INVENTION

The invention provides for a scraping wheel for scraping the skin side of an animal pelt. The scraping wheel comprises a scraping roller including a plurality of scraping teeth arranged on the outer cylindrical roller surface and the scraping roller further comprises a centrally arranged axial roller hole. The scraping wheel also comprises one or more hub parts arranged at least partly in the centrally arranged axial roller hole and connected to the scraping roller through a torque transmitting connection, wherein the one or more hub parts further comprise a centrally arranged axial hub hole by which the scraping wheel is mounted on a drive shaft driving the rotation of the scraping wheel during the scraping.

Providing the scraping roller with a hub part arranged in-between the roller and the drive shaft of the scraping apparatus is advantageous in that it enables that the roller can be formed with a much larger inner diameter, i.e. a larger central hole, whereby reducing the material use of the roller and thereby the cost, substantially without reducing the flexibility.

The larger central hole also provides for a larger outer diameter of e.g. 165 to 200 mm of the scraping roller without excessive use of material, compared to an ordinary outer diameter of about 130 mm. The larger diameter of the scraping roller provides a more stable scraping of the skin side of the tubular fur as the larger diameter roller is less likely to jump from the engagement with the skin side when it encounters a bump or another irregularity of the skin side of the fur.

Furthermore, the rollers are typically moulded—particularly due to the complex teeth desig—and by increasing the diameter of the axial roller hole the reduced material thickness entails that the rollers can more easily be removed from the mould hereby reducing manufacturing time and reducing the cost of the mould, in that the mould can be made from fewer separate parts.

In an aspect of the invention, said torque transmitting connection is formed by a spline joint in which a plurality of splines in said centrally arranged axial roller hole mesh with a plurality of splines on an outer cylindrical surface of said one or more hub parts.

The flexible properties and the reduced material thickness of the roller make it difficult to transmit the necessary torque between the hub part and the roller. However, by forming the torque transmitting connection between the hub and the roller as a spline joint with a plurality of splines, the torque can be transmitted through a plurality of faces hereby reducing the load at any given point of the roller.

In an aspect of the invention, at least some of said splines are undercut, in particular dovetail shaped.

During operation the scraping wheel rotates up to or more than a thousand times per minute and due to the flexible properties and the reduced material thickness of the roller the centripetal force will draw the roller out of shape hereby reducing the scraping accuracy and efficiency. Furthermore, the centripetal force also entails that the splines do not mesh as much hereby reducing the torque transmitting capacity of the spline joint.

However, by forming the splines with an undercut shape, in particular a dovetail shape the roller is also fixed against radial motion relative to the hub part and dimensionally stability of the roller is thereby ensured.

In an aspect of the invention, at said dovetail shaped splines are evenly distributed around the respective surfaces of said scraping roller and said one or more hub parts.

Distributing the splines evenly around the respective surfaces is advantageous in that the torque is hereby also distributed evenly around the respective surfaces hereby increasing the dimensionally stability of the roller and reducing the risk of unwanted stress concentrations building up.

In an aspect of the invention, said torque transmitting connection extends substantially the entire axial extent of said centrally arranged axial roller hole.

If the torque e.g. was only transmitted at one end of the roller the flexible properties and the reduced material thickness of the roller could make the roller twist during use hereby reducing its efficiency and increasing the risk of the roller creating a load in the axial direction which may damage the pelt or at least reduce the efficiency of the scraping.

In an aspect of the invention, said scraping roller is made from a plastic material having a hardness between Shore 60A and Shore 95A.

If the rollers are too hard and rigid the scraping teeth will not be able to compensate for the varying thickness of the pelt both of the entire pelt and locally on the pelt. However, if the rollers are too soft and flexible it is difficult to maintain the shape of the roller during use which may cause unwanted loads and reduce the scraping efficiency of the roller and reduce the durability. Thus, the present hardness range provides for an advantageous relationship between efficiency and durability.

In an aspect of the invention, said plastic material is Polyurethane.

Polyurethane is a durable and stable material particularly suited for making scraping rollers.

In an aspect of the invention, said one or more hub parts are made from metal, such as aluminum.

Metal, such as aluminum, is relatively inexpensive, it is easy to machine and it is very dimensionally stable making it particularly suited for forming a hub for a scraping wheel.

In an aspect of the invention, the outer diameter of said scraping roller is between 25% and 150%, preferably between 50% and 100% and most preferred between 65% and 85% bigger that the outer diameter of said roller hole.

If the outer diameter of the roller becomes too big in relation to the outer diameter of the hole, the material cost of the roller becomes too high and the roller becomes too difficult to remove from the mould during manufacturing. However, if the outer diameter of the roller becomes too small in relation to the outer diameter of the hole, the roller becomes so flexible that it can no longer transfer the necessary torque. Thus, the present size ranges provides for an advantageous relationship between cost and efficiency.

In an aspect of the invention, said centrally arranged axial roller hole is a through-hole.

Forming the axial roller hole as a through-hole is advantageous in that it enables that the torque transmitting connection can extend over the entire axial extent of the roller. Furthermore, through-holes are easy to machine.

The invention also provides for use a scraping wheel according to any of the previously mentioned scraping wheels for scraping of the skin side of a pelt.

Even further, the invention provides for a scraping roller for scraping of the skin side of an animal pelt. The scraping roller comprises a plurality of scraping teeth arranged on the outer cylindrical roller surface and the scraping roller further comprises a centrally arranged axial roller hole, wherein the roller hole is provided with a plurality of dovetail shaped splines.

Providing the centrally arranged axial roller hole in a scraping roller with a plurality of dovetail shaped splines is advantageous in that the plurality of splines enables that torque can be transferred over a large area and forming them with a dovetail shape is advantageous in that it enables that the roller can also be radially fixed so that the roller may maintain its shape even if the roller is relatively flexible and thin-walled.

In an aspect of the invention, at said dovetail shaped splines are evenly distributed around the periphery of said roller through-hole, which is advantageous in that it ensures that the torque can also be transmitted evenly and the shape of the roller can better be maintained constant.

In an aspect of the invention, said dovetail shaped splines extends substantially the entire axial extent of said centrally arranged axial roller hole.

Making the dovetail shaped splines extend substantially the entire axial extent of the hole is advantageous in that it enables that the torque can be transmitted over the entire axial extent of the roller. Furthermore, the roller is easier to manufacture if the dovetail shaped splines extend substantially the entire axial extent of the hole.

FIGURES

Figure 2:
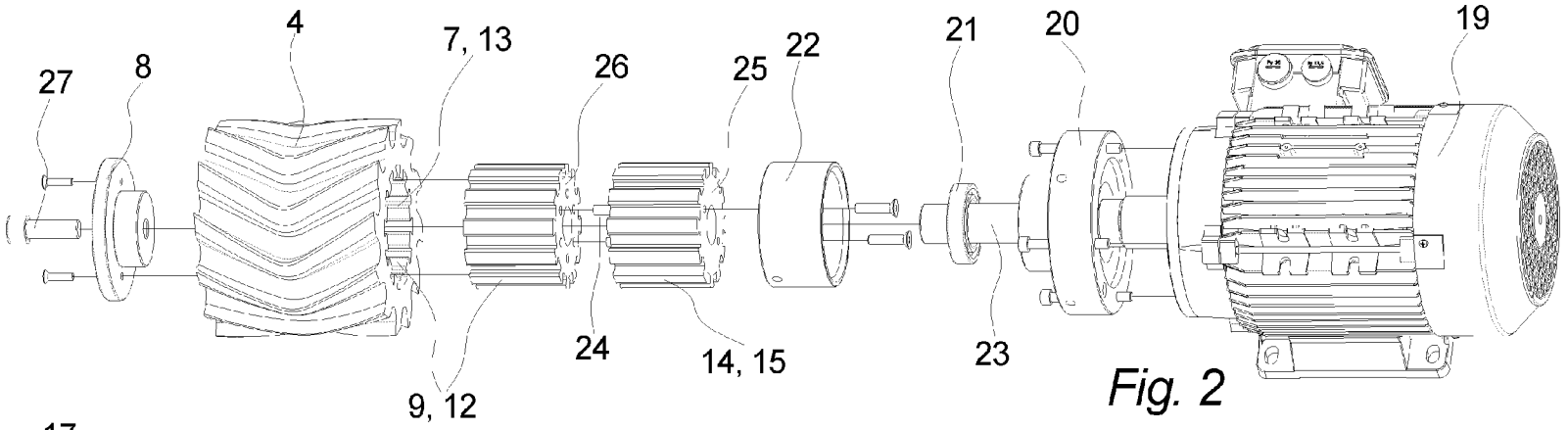
Figure 3:
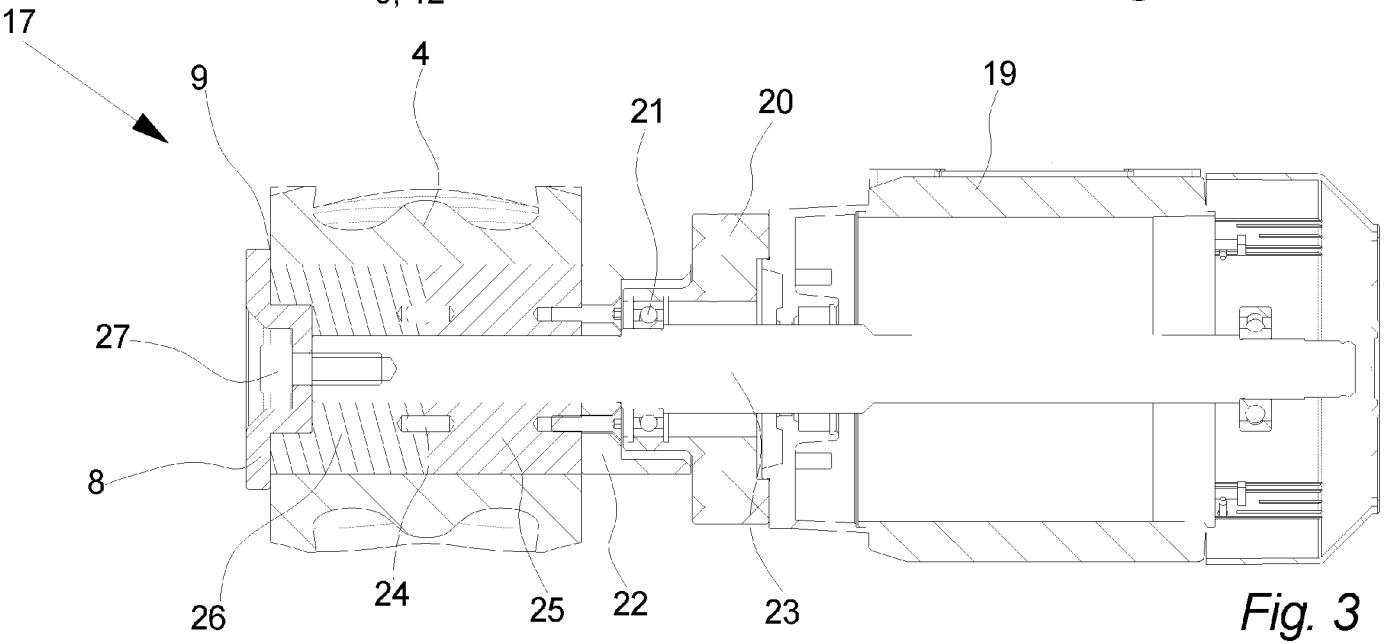
Figure 4:
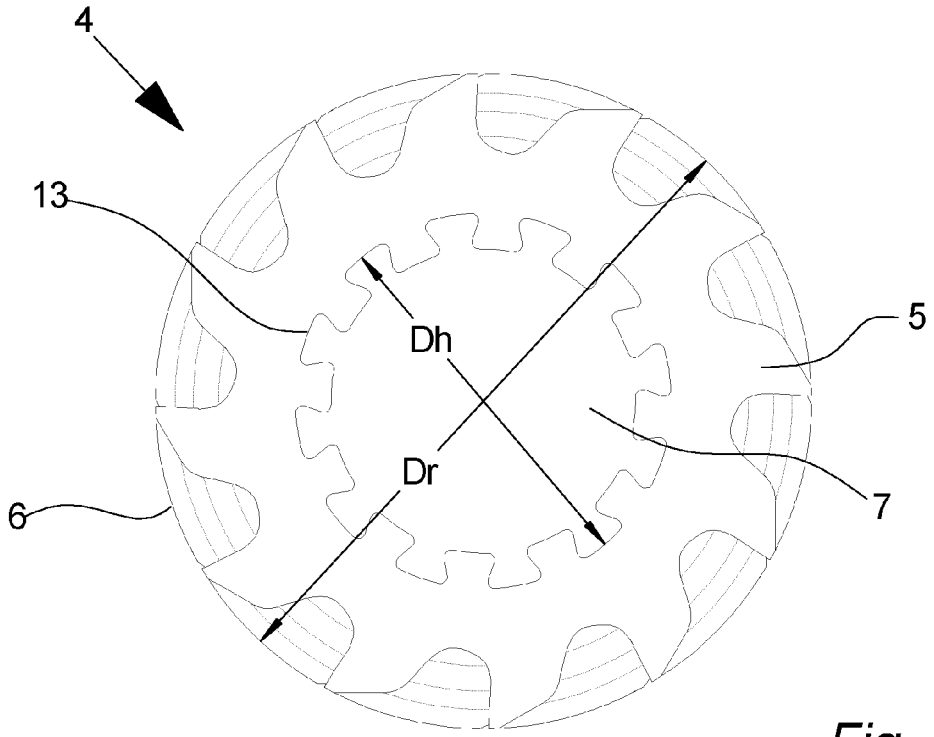
Figure 5:
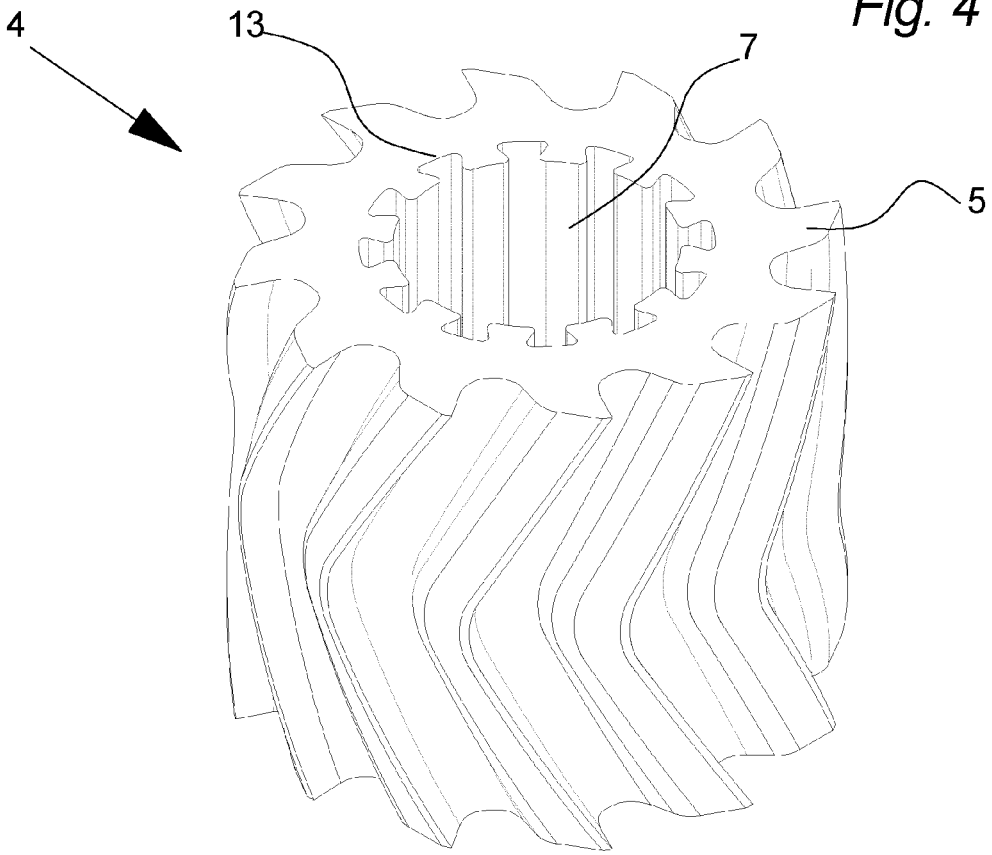
Figure 6:
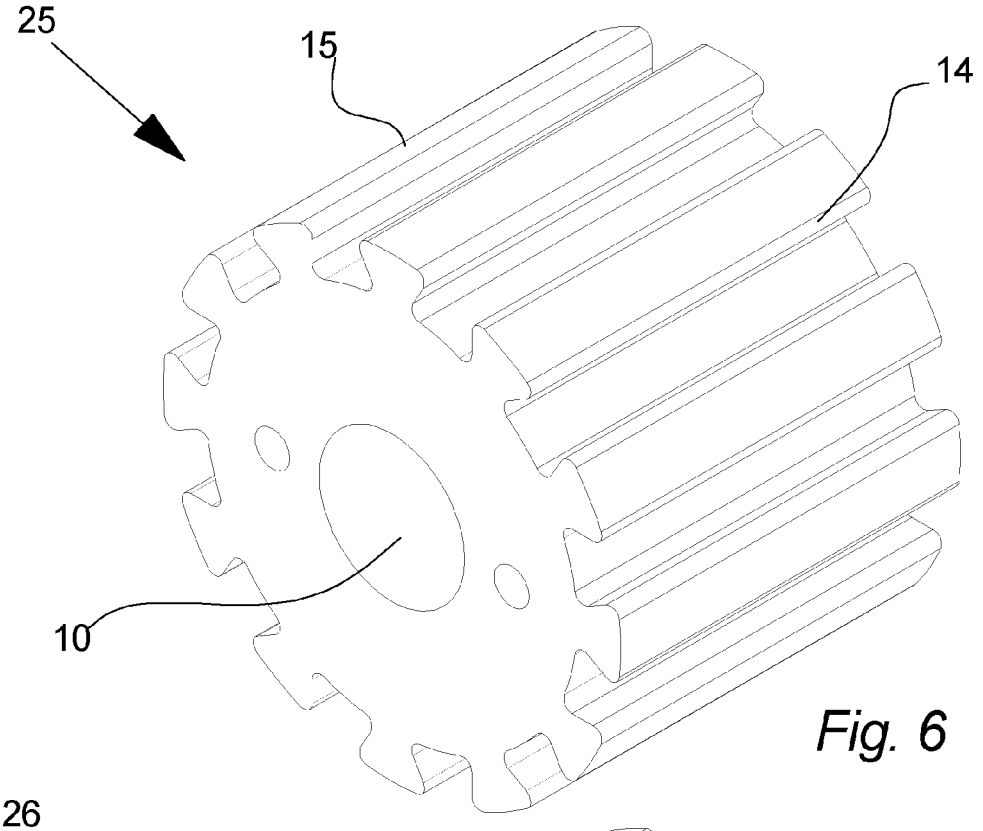
Figure 7:
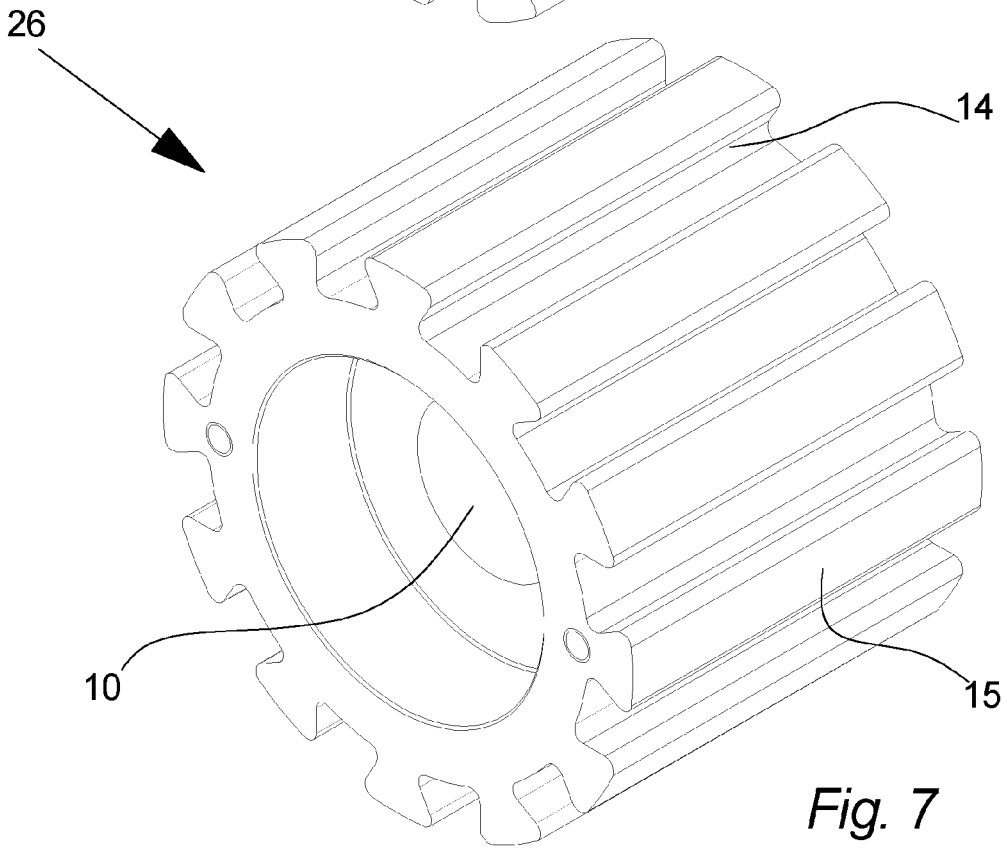

The invention will be described in the following with reference to the figures in which FIG. 1. illustrates a an apparatus for processing the skin side of a tubular fur by scraping the skin side by means of rotating scraping wheels, as seen in perspective, FIG. 2 illustrates an exploded view of a scraping unit, as seen in perspective, FIG. 3 illustrates a cross section through the middle of a scraping unit, as seen from the side, FIG. 4 illustrates a scraping roller, as seen from the front, FIG. 5 illustrates a scraping roller, as seen in perspective, FIG. 6 illustrates a first hub part, as seen in perspective, and FIG. 7 illustrates a second hub part, as seen in perspective.

DETAILED DESCRIPTION

FIG. 1 illustrates a scraping apparatus 16 for processing the skin side 2 of a tubular fur 3 by scraping the skin side 2 of the tubular fur 3 by means of a number of scraping units 17 comprising rotating scraping wheels 1.

The tubular fur 3—which in this embodiment is a mink fur—comprises a fur side and a skin side 2. The fur 3 comprises different skin parts that originally—i.e. before the fur 2 was removed from the furred animal—enclosed different parts of the body of the furred animal.

After the animal has been skinned the tubular fur 3 is drawn onto a mandrel 18 having a tapering end.

The mandrel mounted fur 3 is then transported through the scraping apparatus 16 comprising a number of scraping units 17 arranged to scrape the entire skin surface 2 of the fur 3.

In this embodiment the apparatus 16 comprises two units 17 having a double scraping wheel 1 arrangement and two units 17 having a single scraping wheel 1. However, in another embodiment the apparatus 16 could comprise only units 17 having double scraping wheel 1 arrangements or only units 17 having single scraping wheel 1 arrangements and the apparatus 16 could comprise another number of scraping units 17 such as two, three, five, six or more scraping units 17.

The scraping wheels 1 of each scraping unit 17 are arranged to rotate—against the direction of travel of the pelt 3—while being forced against the skin side 2 of the pelt so any residues of fat, tendons or flesh is efficiently removed from the pelt 3.

In this embodiment the scraping units 17 are arranged to be displaceable towards and away from the mandrel 18 in order to be able to apply a controlled contract pressure against the skin side 2 of the fur 3 on the mandrel 18. This may, for example, be enabled by means of spring arrangements or by linear actuators such as pneumatic cylinders, hydraulic cylinders, a spindle or other.

FIG. 2 illustrates an exploded view of a scraping unit 17, as seen in perspective.

In this embodiment the scraping unit 17 is driven by an electrical motor 19 but in another embodiment the unit 17 could be driven by a pneumatic motor, a hydraulic motor, an internal combustion engine, by a central drive source driving several units 17 or other.

In this embodiment the rotor shaft of the motor 19—i.e. the shaft onto which the rotor part of the electrical motor 19 is attached—extends all the way out of the motor 19 to form the drive shaft 23 of the scraping wheel 1 i.e. the rotor shaft and the drive shaft 23 is formed as one single shaft. However, in another embodiment the rotor shaft and the drive shaft 23 could be formed as two separate shafts e.g. connected by a coupling.

A bearing housing 20 is mounted directly onto the motor flange to fixate a front bearing 21 guiding the drive shaft 23. A bearing cover 22 is placed over the bearing 21 to prevent dirt and foreign objects from entering the bearing 21.

In this embodiment the bearing cover 22 is connected to the drive shaft 23 by means of a set screw (not visible) in the radial threaded hole in the side of the bearing cover 22 however in another embodiment the bearing cover 22 and the other parts placed on and around the drive shaft 23 could be fixed against axial movement individually or in other ways.

The bearing cover 22 is in this embodiment also connected to the scraping wheel 1 by means of two screws extending into a first hub part 25 of the scraping wheel 1.

In this embodiment the scraping wheel 1 consists of two axially divided hub parts 25, 26 arranged inside a single scraping roller 4. However, in another embodiment the hub part 25, 26 could be formed as a single part or the scraping wheel 1 could comprise more than two separate hub parts 25, 26—such as three, four, five, six or more separate hub parts 25, 26—which could be arranged axially, radially or both in relation to each other.

In this embodiment a torque transmitting connection 9 is formed between the scraping roller 4 and the two separate hub parts 25, 26 in that the outer surface 15 of the hub parts 25, 26 and the centrally arranged roller hole 7 are both provided with mutually interlocking and meshing splines 13, 14 forming a spline joint 12 ensuring that a high torque can be transferred between the hub parts 25, 26 and the roller 4.

In this embodiment the two separate hub parts 25, 26 are connected to each other by means of two pins 24 connected to the first hub part 25 and extending into corresponding holes in the second hub part 26 to ensure that the splines 14 on the outside surface 15 of the hub parts 25, 26 are always perfectly aligned when the two hub parts 25, 26 are connected.

To simplify the assembly the second hub part 26 is provided with a plurality of pin hole sets so that if the first hub part 25 is placed inside the scraping roller 4 the pin holes of the second hub part 26 will almost always be aligned with the pins 24. Ideally the second hub part 26 would be provided with a pin hole for every spline 14 so that no matter how the second hub part 26 is orientated—radially—the pin holes will always be aligned with the pins 24. However, in this embodiment the second hub part 26 is only provided with a pin hole for every second spline 14 so that there is a fifty-fifty chance of the pins 24 and the holes being aligned if they were assembled without any control.

In this embodiment the second hub part 26 and the scraping roller 4 is fixated axially on the drive shaft 23 by means of a fixation disc 8 arranged at the end of the drive shaft 23 and connected to this by means of a centrally arranged fixation screw 27. The outer diameter of the fixation disc 8 is in this embodiment so large that the disc 8 presses on the roller 4 as well as on the second hub part 26. At the other end of the scraping roller 4, the roller 4 is pressed against the bearing cover 22 so that the roller 4 is completely fixated against axial displacement in relation to the drive shaft 23.

In this embodiment the fixation disc 8 comprises a centrally arranged depression in which the head of the fixation screw 27 is arranged so that it is more protected against dirt and particles from the scraping process.

In this embodiment the fixation disc 8 is also connected to the second hub part 26 by means of a couple of screws so that if the fixation screw 27 is removed the second hub part 26 would come off along with the fixation disc 8. Thus, if the scraping roller 4 has to be replaced, the fixation screw 27 is removed where after the fixation disc 8 and the second hub part 26—attached to each other—can be removed. This can be done by pulling the roller of the first hub part 25 where after the fixation disc 8 and the second hub part 26 would be removed from the roller 4 and placed on a new roller 4.

In this embodiment the scraping roller 4 is formed as a single annular roller 4 but in another embodiment the roller 4 could be divided axially into more than one roller parts—such as two, three, four or more separate or interlocking roller parts.

FIG. 3 illustrates a cross section through the middle of a scraping unit 17, as seen from the side.

Usually an electrical motor is provided with an internal bearing at either ends of the rotor—i.e. at either ends of the motor housing—but in this embodiment the motor 19 is only provided with one internal bearing at the back of the motor 19 and the front bearing 21 is instead moved out in front of the motor 19 in the bearing housing 20. By this design the front bearing 21 is moved closer to the load point at the scraping roller 4 and can therefore better handle the torque generated by the roller 4 being forced against the pelt 3 or vice versa. Furthermore, this design entails that the front bearing 21 can be made larger and thereby more durable, it is easier to replace and it enables that the drive shaft 23 can be formed longer than a standard electrical motor drive shaft.

In FIGS. 2, 4, 5, 6, and 7 the torque transmitting connection 9 is a spline joint 12 but in this embodiment the torque transmitting connection 9 between the hub parts 25, 26 and the roller 4 is formed by teeth (not shown) on the inside face of the fixation disc 8 engaging corresponding depressions (not shown) in the hub parts 25, 26 and the roller 4. However, in another embodiment the torque transmitting connection 9 could be formed by a separate clamp bushings such as those sold under the registered trademark of Taper Lock, by a shrink connection, by one or more transverse pins, by a key connection or by any other connection suitable for transmitting torque between the hub parts 25, 26 and the roller 4 of a scraping wheel 1.

FIG. 4 illustrates a scraping roller 4, as seen the front.

In this embodiment the scraping roller 4 is provided with twelve splines 13 around the periphery of a centrally arranged axial roller hole 7. In this embodiment the number of splines 13 corresponds with the number of scraping teeth 5 arranged on the outer cylindrical roller surface 6—i.e. the roller 4 also comprises twelve teeth 5 in this embodiment.

However, in another embodiment the number of scraping teeth 5 would not correspond with the number of splines 13 or the roller 4 could comprise another number of teeth and/or splines, such as two, four, seven, ten, fourteen, sixteen, twenty, twenty-four or more.

In this embodiment the splines 13 are dovetail shaped—i.e. the splines 13 are widest towards the outside surface 6 of the roller 4 and more narrow towards the centre of the roller 4—but in another embodiment of the invention the gradient of the sides of the splines 13 could be reversed so that the splines 13 are widest towards the centre of the roller 4 and more narrow towards the outer surface 6 of the roller 4 or the sides of each spline 13 could be parallel. Or the splines 13 could comprise another more or less complex shape but preferably the specific shape of the roller spline 13 would at least partly correspond to the shape of the hub splines 14 (not shown in this figure) to enable that the splines 13, 14 can mesh and thereby transfer torque or even interlock so that splines 13, 14 would also ensure that the hub parts 25, 26 and the roller 4 are also mutually substantially fixed against axial movement.

In this embodiment the outer diameter Dr of the scraping roller 4 is 183 mm and the outer diameter Dh of the roller hole 7 is 105 mm making the outer diameter Dr of the scraping roller 4 approximately 74% bigger that the outer diameter Dh of the roller hole 7. However, in another embodiment the outer diameter Dr of the scraping roller 4 and/or the outer diameter Dh of the roller hole 7 could be either bigger or smaller and the roller diameter Dr/hole diameter Dh ratio could therefore vary accordingly.

Generally, the outer diameter Dr of the scraping roller 4 is preferably in the range of 165 to 200 mm, in particular in the range of 170 to 190 mm, and the outer diameter Dh of the roller hole 7 is in the range of 75 to 135 mm, in particular in the range of 90 to 120 mm.

FIG. 5 illustrates a scraping roller 4, as seen in perspective.

In this embodiment the outer cylindrical roller surface 6 of the scraping roller 4 comprises a plurality of scraping teeth arranged at a peripheral distance from each other that determine or are located on a generally circular, cylindrical surface 6. Each scraping tooth 5 is generally V-shaped. The scraping teeth 5 preferably form an obtuse angle but they can also be straight, be helical, form an acute angle or any combination thereof. The V-shaped scraping teeth's centre points are located in a plane of symmetry that is substantially perpendicular to the roller's axis. As seen in FIG. 4, the scraping roller 4 has an outline that is reminiscent of a circular saw blade.

In this embodiment the scraping roller 4 is made of Polyurethane (PUR) with a hardness of around Shore 70-75A. However, in another embodiment the roller 4 could be both harder, such as Shore 80-85A, or it could be softer such as Shore 62-67A or the roller 4 could be made from another material such as another type of plastic, it could be made from natural or synthetic rubber or from any other similar elastic, ductile material suited for making scraping rollers 4 for a pelt scraping apparatus 16.

As indicated by the arrows in FIG. 1 the scraping roller 4 is preferably caused to rotate in a direction opposite the direction in which the pointy end of the V shaped teeth 5 point. This means that the fur 3 that is processed will first be brought into contact with the free outer ends of each of the scraping teeth 5 and, during the continued rotation of the scraping roller 4, the two points of contact of each of the scraping teeth 5 will move towards the scraping roller's central plane of symmetry where the tip of the V shape is formed. As a consequence of this, the roller 4 will have a tendency to pull the fur 3 on the mandrel 18 in a direction towards this central plane. This situation will, in this connection cause the residues of fat, flesh and/or tendons also to be removed from the parts of the fur 3 located along the edges of the mandrel 18.

Likewise, a scraping roller 4 could also be imagined with scraping teeth 5 with a V shape that causes the roller 4, during its continued rotation, to move the two points of contact of each of the scraping teeth 5 in a direction away from the roller's central plane of symmetry towards free outer ends of each of the scraping teeth 5. As a consequence of this, the scraping roller 4 will have a tendency to pull the fur 3 in a direction away from the roller's plane of symmetry.

In this embodiment the scraping roller 4 is provided with a centrally arranged axial roller hole 7 enabling that the roller 4 can be mounted on a hub part 25, 26 to form a scraping wheel 1.

In this embodiment the roller hole 7 is a through hole and the splines 13 arranged along the periphery of the hole 7 also extends all the way through the roller 4, hereby enabling that the torque transmitting connection 9 between the roller 4 and a hub part 25, 26 may also extend substantially the entire axial extent of the roller 4.

However, in another embodiment the roller hole 7 could also be formed at least partly as a blind hole making the bottom of the blind hole 7 act as a stop for the hub part 25, 26 and hereby fixing the roller 4 against movement in at least one axial direction.

FIG. 6 illustrates a first hub part 25, as seen in perspective and FIG. 7 illustrates a second hub part 26, as seen in perspective.

In this embodiment both hub parts 25, 26 are made from aluminum which enables that the hub parts 25, 26 can be extruded. The cost of the producing the hub parts 25, 26 even though they comprise very complex shapes can thereby be reduced and at the same time the hub parts 25, 26 can be mass produced with a very high dimensionally accuracy.

However, in another embodiment the hub parts 25, 26 could be made from another metal such as steel, cast-iron, stainless steel or another metal, they could be made from hard rigid plastic material e.g. fiber reinforced or any combination of the mentioned materials.

In this embodiment the hub parts 25, 26 are provided with a centrally arranged axial hub hole 10 enabling that the hub parts 25, 26 can be mounted on a drive shaft 11.

In this embodiment the hub holes 10 are both through holes but in another embodiment at least one of the holes 10 could be formed at least partly as a blind hole making the bottom of this blind hole 10 act as a stop for the hub part 25, 26 and hereby fixing the hub part 25, 26 against movement in at least one axial direction in relation to the drive shaft 23 on which the hub parts 25, 26 are mounted.

In this embodiment the splines 14 arranged along the entire outer cylindrical surface 15 of the hub parts 25, 26 extends the entire axial extent of both hub parts 25, 26, hereby enabling that the torque transmitting connection 9 between a roller 4 and the hub part 25, 26 may also extend substantially the entire axial extent of the hub parts 25, 26.

However, in another embodiment the splines 14 of at least one of the hub parts 25, 26 could extend only some of the axial extent of the hub parts 25, 26.

The invention has been exemplified above with reference to specific examples of scraping wheels 1, scraping rollers 4, hub parts 25, 26 and other. However, it should be understood that the invention is not limited to the particular examples described above but may be designed and altered in a multitude of varieties within the scope of the invention as specified in the claims.

LIST

1. Scraping wheel
2. Skin side of pelt
3. Animal pelt
4. Scraping roller 5. Scraping teeth
6. Outer cylindrical roller surface
7. Centrally arranged axial roller hole
8. Fixation disc
9. Torque transmitting connection
10. Centrally arranged axial hub hole
11. Drive shaft
12. Spline joint
13. Roller spline
14. Hub spline
15. Outer cylindrical surface of hub part
16. Scraping apparatus
17. Scraping unit
18. Mandrel
19. Electric motor
20. Bearing housing
21. Front bearing
22. Bearing cover
23. Drive shaft
24. Pin
25. First hub part
26. Second hub part
27. Fixation screw
Dr. Outer diameter of scraping roller
Dh. Outer diameter of roller hole

The invention claimed is:

1. A scraping wheel for scraping the skin side of an animal pelt, said scraping wheel comprising a scraping roller including a plurality of scraping teeth arranged on an outer cylindrical roller surface, said scraping roller further comprising a centrally arranged axial roller hole, and one or more hub parts arranged at least partly in said centrally arranged axial roller hole and connected to said scraping roller through a torque transmitting connection, formed by a spline joint in which a plurality of roller splines in said centrally arranged axial roller hole mesh with a plurality of hub splines on an outer cylindrical surface of said one or more hub parts, wherein at least some of said splines are undercut, wherein said one or more hub parts further comprise a centrally arranged axial hub hole by which said scraping wheel is mounted on a drive shaft driving the rotation of said scraping wheel during said scraping, and wherein an outer diameter of said scraping roller is between 65% and 150% bigger than an outer diameter of said roller hole.

2. A scraping wheel according to claim 1, wherein said torque transmitting connection extends substantially an entire axial extent of said centrally arranged axial roller hole.

3. A scraping wheel according to claim 1, wherein said scraping roller is made from a plastic material having a hardness between Shore 60A and Shore 95A.

4. A scraping wheel according to claim 3, wherein said plastic material is Polyurethane.

5. A scraping wheel according to claim 1, wherein said one or more hub parts are made from metal.

6. A scraping wheel according to claim 1, wherein said centrally arranged axial roller hole is a through-hole.

7. The scraping wheel according to claim 1, wherein at least some of said splines are dovetail shaped.

8. A scraping wheel according to claim 7, wherein at said dovetail shaped splines are evenly distributed around the respective surfaces of said scraping roller and said one or more hub parts.

9. The scraping wheel according to claim 1, wherein an outer diameter of said scraping roller is between 65% and 85% bigger than an outer diameter of said roller hole.

10. A method for scraping of the skin side of a pelt, the method comprising:

providing a scraping wheel, the scraping wheel comprising:

a scraping roller including a plurality of scraping teeth arranged on an outer cylindrical roller surface, said scraping roller further comprising a centrally arranged axial roller hole, wherein an outer diameter of said scraping roller is between 65% and 150% bigger than an outer diameter of said roller hole, and one or more hub parts arranged at least partly in said centrally arranged axial roller hole and connected to said scraping roller through a torque transmitting connection formed by a spline joint in which a plurality of roller splines in said centrally arranged axial roller hole mesh with a plurality of hub splines on an outer cylindrical surface of said one or more hub parts, wherein at least some of said splines are undercut, wherein said one or more hub parts further comprise a centrally arranged axial hub hole by which said scraping wheel is mounted on a drive shaft driving the rotation of said scraping wheel during said scraping; and scraping the skin side of the pelt.

11. A scraping roller for scraping of the skin side of an animal pelt, said scraping roller comprising a plurality of scraping teeth arranged on an outer cylindrical roller surface, said scraping roller further comprising a centrally arranged axial roller hole, wherein an outer diameter of said scraping roller is between 65% and 150% bigger than an outer diameter of said roller hole, and wherein said roller hole is provided with a plurality of dovetail shaped splines.

12. A scraping roller according to claim 11, wherein at said dovetail shaped splines are evenly distributed around a periphery of said roller hole.

13. A scraping roller according to claim 11, wherein said dovetail shaped splines extend substantially an entire axial extent of said centrally arranged axial roller hole.

14. A scraping roller according to claim 11, wherein said scraping roller is made from a plastic material having a hardness between Shore 60A and Shore 95A.

15. A scraping roller according to claim 14, wherein said plastic material is Polyurethane.

16. A scraping roller according to claim 11, wherein said centrally arranged axial roller hole is a through-hole.

* * * * *